US010283862B2

(12) United States Patent
Klemes

(10) Patent No.: US 10,283,862 B2
(45) Date of Patent: May 7, 2019

(54) PHASE-MODE FEED NETWORK FOR ANTENNA ARRAYS

(71) Applicant: Marek Klemes, Ottawa (CA)

(72) Inventor: Marek Klemes, Ottawa (CA)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 379 days.

(21) Appl. No.: 15/295,366

(22) Filed: Oct. 17, 2016

(65) Prior Publication Data

US 2018/0108991 A1 Apr. 19, 2018

(51) Int. Cl.

| | |
|---|---|
| ***H01Q 3/36*** | (2006.01) |
| ***H01Q 3/40*** | (2006.01) |
| ***H01Q 21/00*** | (2006.01) |
| ***H01Q 21/06*** | (2006.01) |
| ***H01Q 21/20*** | (2006.01) |

(52) U.S. Cl.

CPC ..... *H01Q 3/40* (2013.01); *H01Q 3/36* (2013.01); *H01Q 21/0006* (2013.01); *H01Q 21/067* (2013.01); *H01Q 21/20* (2013.01)

(58) Field of Classification Search

CPC ..... H01Q 3/40; H01Q 21/20; H01Q 21/067; H01Q 21/0006; H01Q 3/36

USPC ..... 342/372

See application file for complete search history.

(56) References Cited

U.S. PATENT DOCUMENTS

| | | | | |
|---|---|---|---|---|
| 3,827,055 | A * | 7/1974 | Bogner | H01Q 3/242 342/376 |
| 4,814,775 | A * | 3/1989 | Raab | H01Q 3/40 342/368 |
| 9,413,067 | B2 | 8/2016 | Klemes | |
| 2004/0090286 | A1* | 5/2004 | Runyon | H01P 5/04 333/117 |
| 2005/0017822 | A1* | 1/2005 | Runyon | H01P 5/04 333/117 |
| 2005/0259019 | A1* | 11/2005 | Miles | H01Q 1/246 343/754 |
| 2007/0210976 | A1 | 9/2007 | Luk et al. | |
| 2014/0266901 | A1 | 9/2014 | Klemes et al. | |

(Continued)

OTHER PUBLICATIONS

U.S. Appl. No. 13/870,309, filed Apr. 25, 2013.

(Continued)

*Primary Examiner* — Frank J McGue

(57) ABSTRACT

A sparse phase-mode feed network for an antenna array is described. The waveguide assembly includes a plurality of radiating element probes for coupling to respective radiating elements of the antenna array, and a plurality of phase-mode feed probes. A variable phase shifter is positioned in the waveguide assembly in an annular region between the radiating element probes and the phase-mode feed probes to cause additional progressive electrical phase shifts of the radiating elements of the antenna array from 0 to 2πK radians, the phase shift progressing for one complete physical angular cycle in the plane of the waveguide assembly. A beam forming network couples the phase-mode feed probes to a plurality of phase-mode feed ports corresponding to respective consecutive-order phase modes of the antenna array. When coupled to the antenna array, respective orders of the phase modes provided at the phase-mode feed ports are selectable in accordance with K.

22 Claims, 9 Drawing Sheets

(56) References Cited

U.S. PATENT DOCUMENTS

| | | | |
|---|---|---|---|
| 2015/0349422 | A1 | 12/2015 | Klemes et al. |
| 2016/0218429 | A1 | 7/2016 | Klemes |

OTHER PUBLICATIONS

U.S. Appl. No. 14/295,235, filed Jun. 3, 2014.
Kuangda Wang and Ke Wu, "Liquid Crystal Enabled Substrate Integrated Waveguide Variable Phase Shifter for Millimeter-Wave Applications at 60 GHz and Beyond", Proceedings of IEEE International Microwave Symposium IMS, 2015.
Tiezhu Yuan, Hongqiang Wang, Yuliang Qin, and Yongqiang Cheng, "Electromagnetic Vortex Imaging Using Uniform Concentric Circular Arrays" IEEE Antennas and Wireless Propagation Letters, vol. 15, pp. 1024-1027, 2016.
U.S. Appl. No. 14/948,879, filed Nov. 23, 2015.

* cited by examiner $$\begin{bmatrix} C \\ D \end{bmatrix} = \frac{1}{\sqrt{2}} \begin{bmatrix} 1 & 1 \\ 1 & -1 \end{bmatrix} \bullet \begin{bmatrix} A \\ B \end{bmatrix}$$

$$\begin{bmatrix} G \\ H \end{bmatrix} = \frac{1}{\sqrt{2}} \begin{bmatrix} -j & 1 \\ 1 & -j \end{bmatrix} \bullet \begin{bmatrix} E \\ F \end{bmatrix}$$

PHASE-MODE FEED NETWORK FOR ANTENNA ARRAYS

FIELD

The present disclosure relates to beam-steering of antenna arrays. In particular, the present disclosure relates to a phase-mode feed network for an antenna array.

BACKGROUND

An antenna array is a set of individual radiating elements, connected together to act as a single antenna, with a main beam or lobe. Conventionally, an antenna array may be referred to as a single antenna. Beam steering is the angular positioning of the main beam by controlling the amplitude and/or phase of the individual radiating elements. Beam steering allows the antenna array to transmit in a preferential direction, namely the direction of the main beam, or provide increased reception sensitivity to signals received from the direction of the main beam. In order to obtain a desired radiation pattern for the main beam, different phase modes of the antenna array may be combined.

Circuitry for beam steering may comprise individual phase-shifters and/or delay units for each of the individual radiating elements that make up the antenna array. As the target frequency range of an antenna increases, the ideal spacing of radiating elements in the array decreases. The reduced spacing between radiating elements may increase the complexity in implementing the beam steering circuitry and feed network used to connect to the radiating elements, as the beam steering circuitry and feed network generally do not scale with wavelength, unlike antenna structures.

SUMMARY

In order to achieve a main beam having a greater tilt from the z-axis (i.e., greater radial steering range, or polar angle), it may be necessary to combine higher order phase modes of the antenna array. Various examples described herein enable the requisite higher order phase modes to be created, using a single control signal.

In various examples, a sparse phase-mode feed network is described. The feed network enables any number of radiating elements in an antenna array to be fed by a smaller number of phase-mode feed probes. In some examples, there are four phase-mode feed probes coupled to phase-mode feed ports. Three phase-mode feed ports may be used to access three consecutive order phase modes of the antenna array, where the order of the phase modes is selectable by a control signal.

In some examples, the present disclosure describes a feed network for a steerable antenna array. The feed network includes a waveguide assembly including a plurality of radiating element probes for coupling to respective radiating elements of the antenna array, and a plurality of phase-mode feed probes. The feed network also includes a variable phase shifter positioned in the waveguide assembly in an annular region between the radiating element probes and the phase-mode feed probes to cause additional phase shifts of the radiating elements of the antenna array. The phase shifter is configured to cause additional progressive electrical phase shifts in the antenna array from 0 to $2\pi K$ radians. The phase shift progresses for one complete physical angular cycle in a plane of the waveguide assembly, where K is an integer value represented by a phase shift control signal. The feed network also includes a beam forming network coupling the phase-mode feed probes to a plurality of phase-mode feed ports corresponding to respective consecutive-order phase modes of the antenna array. When coupled to the antenna array, respective orders of the phase modes provided at the phase-mode feed ports are selectable in accordance with K.

In some examples, the present disclosure describes an apparatus for beam steering a steerable antenna array. The apparatus includes a feed network. The feed network includes a waveguide assembly including a plurality of radiating element probes for coupling to respective radiating elements of the antenna array, and a plurality of phase-mode feed probes. The feed network also includes a variable phase shifter positioned in the waveguide assembly in an annular region between the radiating element probes and the phase-mode feed probes to cause additional phase shifts of the radiating elements of the antenna array. The phase shifter is configured to cause additional progressive electrical phase shifts in the antenna array from 0 to $2\pi K$ radians. The phase shift progresses for one complete physical angular cycle in a plane of the waveguide assembly, where K is an integer value represented by a phase shift control signal. The feed network also includes a beam forming network coupling the phase-mode feed probes to a plurality of phase-mode feed ports corresponding to respective consecutive-order phase modes of the antenna array. When coupled to the antenna array, respective orders of the phase modes provided at the phase-mode feed ports are selectable in accordance with K. The apparatus also includes a beam steering circuitry coupled to two or more phase-mode feed ports of the feed network. The beam steering circuitry combines phase modes from two or more of the phase-mode feed ports to generate a main beam of the steerable antenna array. The beam steering circuitry controls the polar angle and azimuth angle of the main beam to direct the main beam in a desired direction.

In some examples, the present disclosure describes a steerable antenna array system. The system includes a plurality of radiating elements arranged in a planar antenna array. The system also includes a feed network. The feed network includes a waveguide assembly including a plurality of radiating element probes for coupling to respective radiating elements of the antenna array, and a plurality of phase-mode feed probes. The feed network also includes a variable phase shifter positioned in the waveguide assembly in an annular region between the radiating element probes and the phase-mode feed probes to cause additional phase shifts of the radiating elements of the antenna array. The phase shifter is configured to cause additional progressive electrical phase shifts in the antenna array from 0 to $2\pi K$ radians. The phase shift progresses for one complete physical angular cycle in a plane of the waveguide assembly, where K is an integer value represented by a phase shift control signal. The feed network also includes a beam forming network coupling the phase-mode feed probes to a plurality of phase-mode feed ports corresponding to respective consecutive-order phase modes of the antenna array. When coupled to the antenna array, respective orders of the phase modes provided at the phase-mode feed ports are selectable in accordance with K. The system also includes a beam steering circuitry coupled to two or more phase-mode feed ports of the feed network. The beam steering circuitry combines phase modes from two or more of the phase-mode feed ports to generate a main beam of the steerable antenna array. The beam steering circuitry controls the polar angle and azimuth angle of the main beam to direct the main beam in a desired direction.

In examples disclosed herein, the waveguide assembly may be configured for a circular antenna array, and the progressive phase shift caused by the variable phase shifter progresses linearly in a circular direction.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DESCRIPTION OF EXAMPLE EMBODIMENTS

The present disclosure describes a sparse phase-mode feed network that does not require a full N-port network to feed N radiating elements in an antenna array. In examples described below, three phase-mode ports are used to feed N radiating elements, using four feed probes. The phase-modes at the three phase-mode ports are three consecutive order phase-modes, which may be selected using a single control signal. Examples described below may be suitable for use with a planar circular antenna array.

Figure 1:
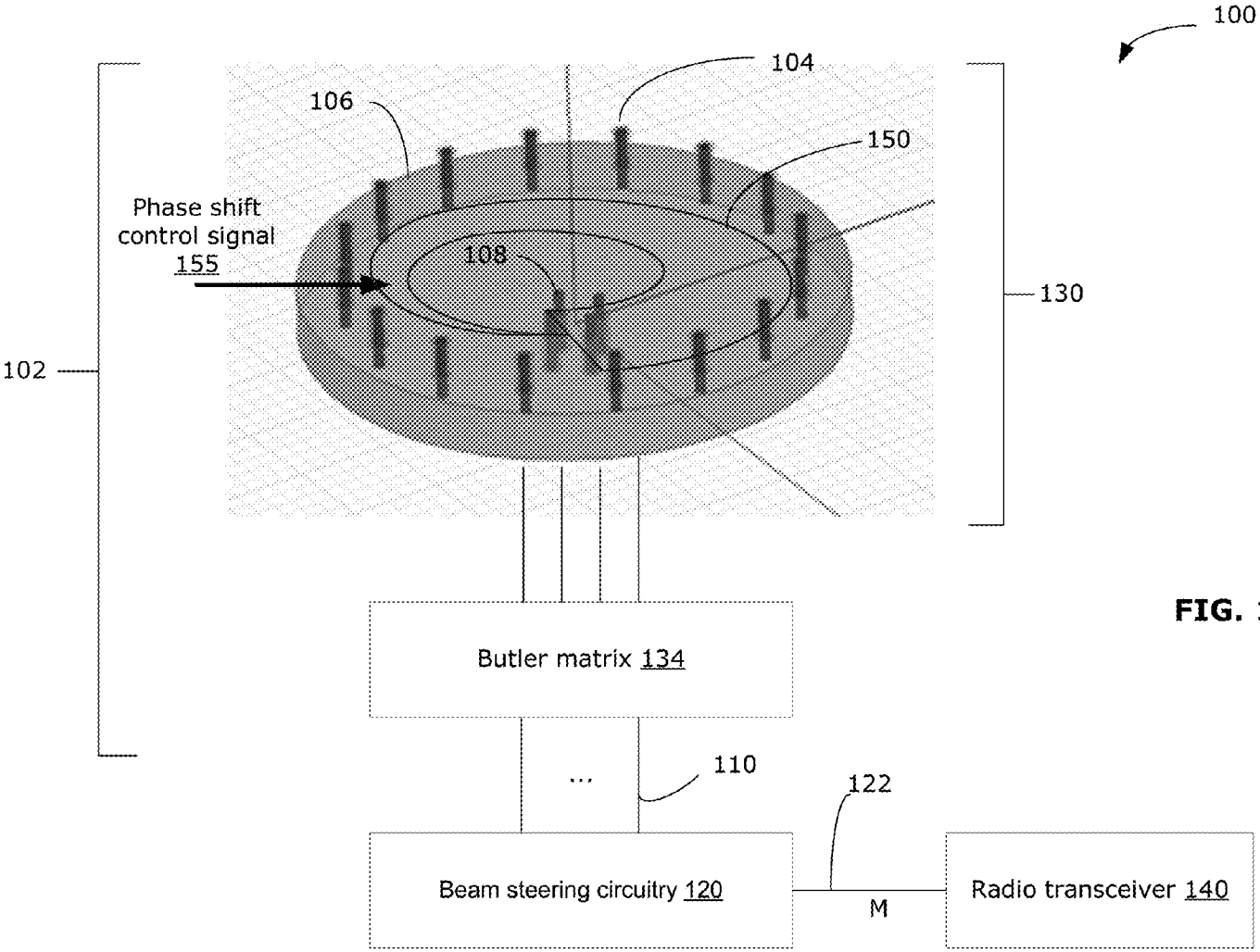
FIG. 1 is a schematic diagram illustrating an example system for beam steering of a planar circular antenna array.

FIG. 1 schematically illustrates components of an example system for beam steering of a steerable antenna array. The system 100 may be used for both transmission and reception. The system 100 includes a circular antenna array (not shown) and a feed network 102. Although other antenna array arrangements may be suitable, in examples described herein the antenna array has a set of N radiating elements (not shown) arranged in a planar circular array. Generally, the antenna array may have any arrangement of radiating elements (e.g., in a circular or polygonal configuration), provided the radiating elements are arranged such that they give rise to the phase modes (e.g., radiating elements are arranged along the perimeter of the polygon or arranged concentrically in the case of a filled array). The individual radiating elements are arranged at a spacing of approximately half the wavelength λ at which the antenna array is designed to operate. Each of the individual radiating elements is connected to a respective radiating element probe 104 of a radial waveguide transition assembly 130. Each radiating element probe 104 provides the transmission or reception signal to or from the respective radiating element.

In the example shown, the radiating element probes 104 are arranged in a circular pattern, corresponding to the arrangement of the radiating elements, about a periphery of a circular transverse electromagnetic (TEM) region 106 of the radial waveguide transition assembly 130. In this example, a plurality of phase-mode feed probes 108 are arranged in a circular pattern that is coaxial with the circular pattern of the radiating element probes 104. Notably, the number n of phase-mode feed probes 108 is less than the number N of radiating elements. In the example of FIG. 1, n=4; however, other values of n may be used. For example, n=8 or 16 may be used. The phase-mode feed probes 108 are spaced approximately ¼ of the wavelength λ apart. The phase-mode feed probes 108 are coupled to phase-mode feed ports 110 of the feed network 102, via a beam forming network, such as a Butler matrix. An n×n Butler matrix 134 having n antenna-side ports and n input/output ports may be used to couple the phase-mode feed probes 108 to the phase-mode feed ports 110. Details of the Butler matrix 134 are described further below.

When the phase-mode feed ports 110 are coupled to the phase-mode feed probes 108 (via a beam forming network such as the Butler matrix 134), each of the phase-mode feed ports 110 may correspond to the antenna array transmitting, or receiving, signals according to different orders of phase modes, discussed further below.

The phase-mode feed ports 110 are coupled to a beam steering circuitry 120, which provides a steered main beam M at a main port 122. Examples of suitable beam steering circuitries are described in U.S. patent application Ser. No. 14/295,235 filed Jun. 3, 2014 and entitled "System and Method for Simple 2D Phase-Mode Enabled Beam-Steering"; U.S. patent application Ser. No. 13/870,309 filed Apr. 25, 2013 and entitled "Simple 2D Phase-Mode Enabled Beam-Steering Means"; and in U.S. patent application Ser. No. 14/948,879 filed Nov. 23, 2015 and entitled "Four-Mode Planar Feed for Circular Arrays". The above references are hereby incorporated by reference in their entirety.

It should be noted that the phase-mode feed ports 110 coupled to the beam steering circuitry 120 may be fewer than the input/output ports of the Butler matrix 134. For example, one or more of the input/output ports of the Butler matrix 134 may be terminated. The beam steering circuitry 120 may combine signals from two or more phase-mode feed ports 110 to obtain a desired main beam M directed at a desired direction. For example, two or more of the phase modes of the antenna array may be combined to achieve a desired tilt, or polar angle, of the main beam M. The beam steering circuitry 120 may control the radial (i.e., polar angle) and circumferential (i.e., azimuth angle) directions of the main beam M in order to enable scanning of the antenna array in desired directions. A phase shift control signal 155 is used to control phase shift of the radiating elements of the antenna array. The phase shift control signal 155 is used to control a variable phase shifter 150 in the waveguide assembly 130, discussed further below. The variable phase shifter 150 is shown as a spiral in various figures for the purpose of illustration only. Further, the variable phase shifter 150 may be incorporated into the waveguide assembly 130. The phase shift control signal 155 may be outputted to the variable phase shifter 150 from the beam steering circuitry 120 or from a separate circuitry. The main beam M, provided at the main port 122 of the beam steering circuitry 120, is provided to a radio transceiver 140 for use in transmission/reception.

Figure 2:
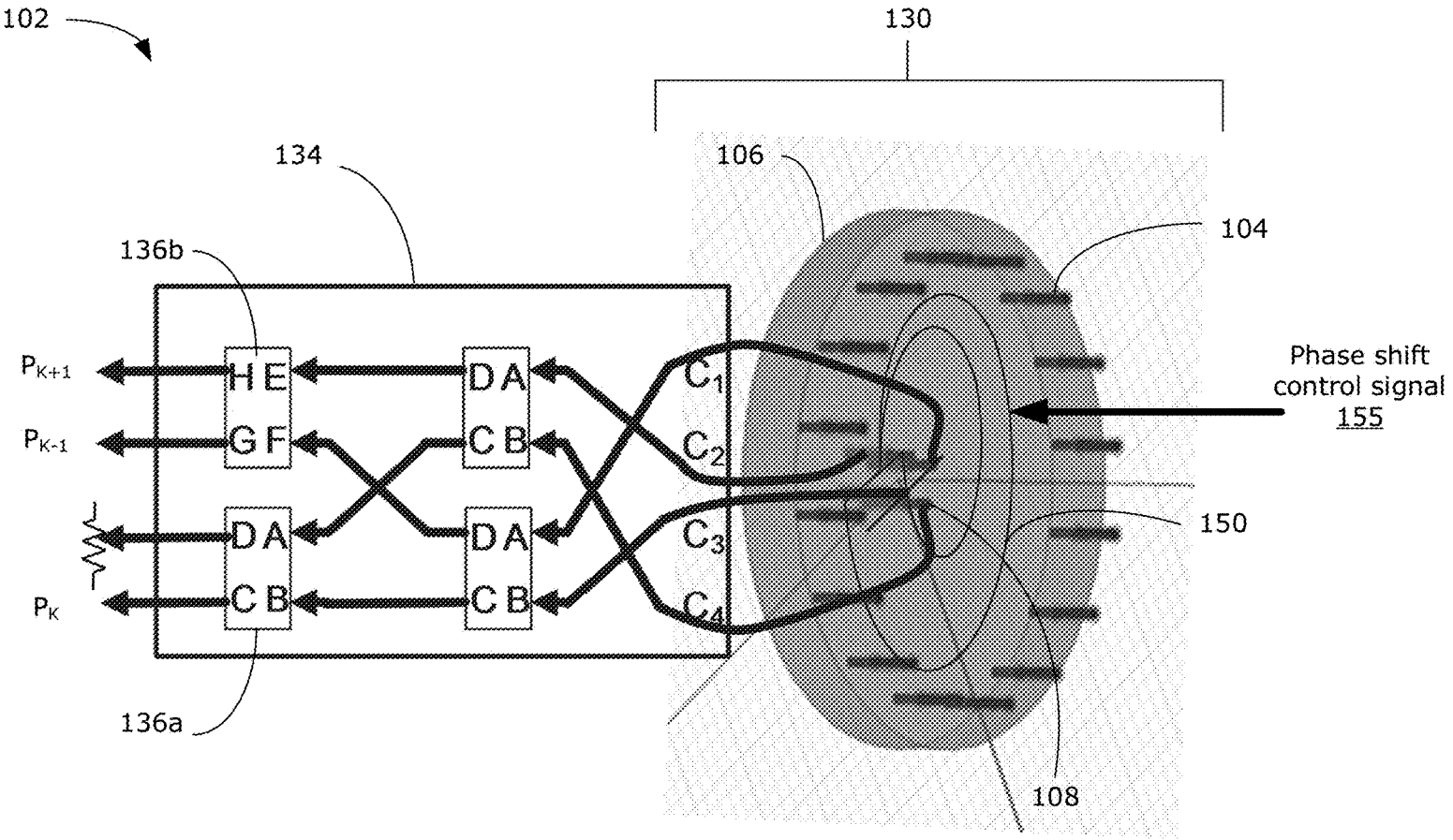
FIG. 2 is a schematic diagram representing example sparse phase-mode feed network suitable for use in the system of FIG. 1.

FIG. 2 schematically shows the feed network 102 comprising an example 4×4 Butler matrix 134 coupled to the waveguide assembly 130. As shown, the Butler matrix 134 has four antenna-side ports $C_1$, $C_2$, $C_3$, $C_4$ which are connected to respective phase-mode feed probes 108 of the waveguide assembly 130. The Butler matrix 104 also has four I/O ports that couple to the phase-mode feed ports 110 which form the electrical interfaces to the beam steering circuitry 120. Where there is a greater or fewer number of phase-mode feed probes 108, the size of the Butler matrix 134 is adjusted accordingly.

The waveguide assembly 130 includes a variable phase shifter 150 that is controlled by the phase shift control signal 155. The phase shift control signal 155 represents a variable integer value K. For example, K may be an integer in the range of 0 to ±N/2, where N is the number of radiating elements in the antenna array. The variable phase shifter 150 will be described further below. The presence of the variable phase shifter 150 enables higher order phase modes of the antenna array to be made selectively available at the phase-mode feed ports 110. By incorporating the variable phase shifter 150 into the waveguide assembly 130, the phase modes available at the phase-mode feed ports 110 are the Kth, (K+1)th, (K−1)th and (K+2)th order phase modes (with K being controlled using the phase shift control signal 155), which may be referred to as signals $P_K$, $P_{K+1}$, $P_{K-1}$ and $P_{K+2}$. Generally, the phase modes available at the phase-mode feed ports 110 are of consecutive order. In the example of FIG. 2, the phase-mode feed port 110 for $P_{K+2}$ may be terminated, because the (K+2)th order phase mode is degenerate when using four phase-mode feed probes 108 and a 4×4 Butler matrix 134. In other examples, $P_{K+2}$ may be used.

Figure 3:
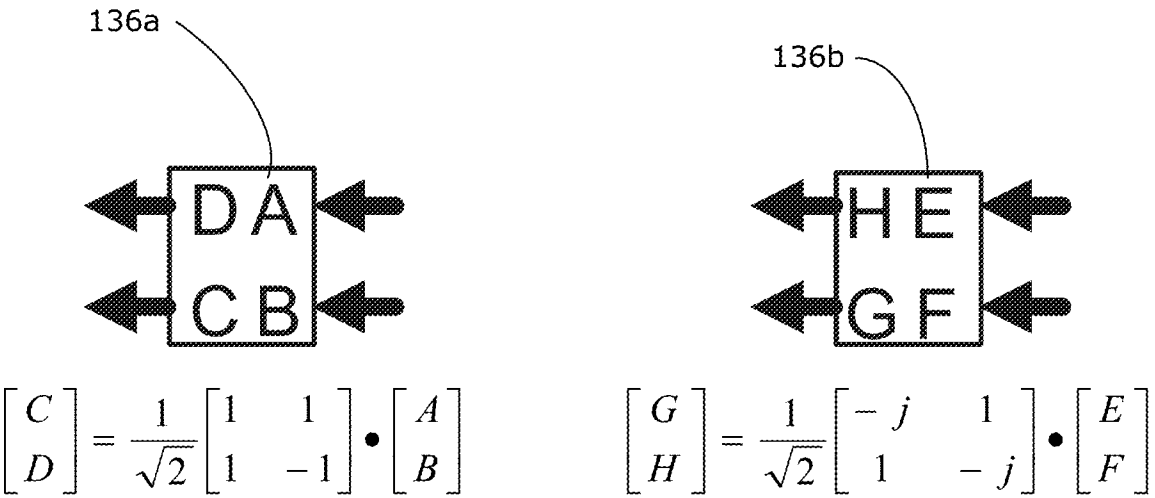
FIG. 3 illustrates example hybrid splitter/combiners suitable for use in the feed network of FIG. 2.

The Butler matrix 134 may be formed as a planar network of hybrid splitter/combiners 136, which may be referred to simply as hybrids 136. As shown in FIG. 2, the Butler matrix 134 may include 180° hybrids 136*a* as well as a 90° hybrid 136*b* (collectively referred to as hybrids 136). The relationship between the ports of the hybrids 136*a*, 136*b* is shown in FIG. 3.

The signals at the I/O ports $P_K$, $P_{K+1}$, $P_{K-1}$, $P_{K+2}$ are related to the signals at the antenna-side ports $C_1$, $C_2$, $C_3$, $C_4$ via the hybrids 136, and have the following relationship:

$$\begin{bmatrix} P_{K+1} \\ P_{K-1} \\ P_{K+2} \\ P_K \end{bmatrix} = \frac{1}{2}\begin{bmatrix} -j & 1 & j & -1 \\ 1 & -j & -1 & j \\ -1 & 1 & -1 & 1 \\ 1 & 1 & 1 & 1 \end{bmatrix}\begin{bmatrix} C_1 \\ C_2 \\ C_3 \\ C_4 \end{bmatrix}$$

In other examples, different numbers of hybrids 136 and/or other types of hybrids 136, or beam forming networks other than a Butler matrix 134 may be used instead of the arrangement described above.

In some examples, the waveguide assembly 130 may provide a circular transition region from azimuthal to axial TEM propagation. For example, the waveguide assembly 130 may be similar to that described in U.S. patent application Ser. No. 14/948,879 filed Nov. 23, 2015 and entitled "Sparse Phase-Mode Planar Feed for Circular Arrays", incorporated herein by reference in its entirety. The waveguide assembly 130 additionally has a variable phase shifter 150 incorporated therein, as discussed below with reference to FIGS. 4 and 5.

An example configuration of the waveguide assembly 130 is now described. The example configuration described here may be suitable for use with a planar circular antenna array. In an example, the waveguide assembly 130 includes substantially parallel conductive circular disks separated by about ¼ wavelength λ of dielectric. The disk separation is less than or equal to about half wavelength λ. The diameter of the circular disks is dependent on the number, N, of radiating element so that their respective N radiating element probes 104 are about half wavelength λ apart and ¼ wavelength λ from a circumferential vertical conductive wall joining the top and bottom circular disks. In this example, there are four phase-mode feed probes 108 symmetrically spaced around the center of the circular disks, for example in a square with a diagonal of about 1/π of the wavelength λ, or evenly spaced around a circle, about ¼ wavelength λ of arc apart. The four phase-mode feed probes 108 have their outer conductors connected to the bottom disk and their inner conductors protruding about ⅛ wavelength λ into the space between the disks, but not touching the top disk. The N outer radiating element probes 104 have their outer conductors connected to the top disk and their inner conductors protruding about ⅛ wavelength λ into the space between the disks, but not touching the bottom disk. The other ends of the four phase-mode feed probes 108 inner conductors are connected to the antenna-side ports $C_1$, $C_2$, $C_3$, $C_4$ of the planar 4×4 Butler matrix 134 via impedance-matching structures as may be required to match its characteristic impedance. The other ends of the N radiating element probes 104 inner conductors are connected to the radiating elements via matched-impedance element-feed planar or non-planar networks. This planar construction may enable easier incorporation into the antenna array and feed network, and may also enable stacking of multiple waveguide assemblies 130.

Example dimensions and properties of the above example configuration are now described. In an example, λ=1.876 mm. The example dielectric used in the coaxial probes and between the disks has the following properties: $\in_r$=7.1, DuPont 9K7 LTCC material, f=60 GHz. The disk separation=0.53 mm (i.e., 0.2824λ or approximately λ/4). The spacing from center of disk to the center of each phase-mode feed probe 108 $R_p$=0.298 mm (approximately λ/2π), so spacing between phase-mode feed probes 108 is √(2) *0.298=0.421 mm (i.e., approximately λ/4 along the arc length). The probe height between the parallel metal circular disks=0.234 mm (i.e., approximately λ/8). The diameter of the inner layer of the phase-mode feed probes 108 is about 115 μm (about 0.0617λ). The coaxial port outer diameter is about 200 μm (about λ/10). The radiating element probes 104 are spaced apart approximately λ/2, at a radius of $R_e$=2.3886 mm, where $R_e$ is the radius of the circle on which lie the radiating element probes 104. The phase-mode feed probes 108 are terminated in 12.06Ω resistors. The outer wall, which may be formed as a via fence for example as done with substrate-integrated waveguides (SIW) in printed circuit board (PCB) implementations, connects the top and bottom metal disks at $R_d$=$R_e$+λ/4=2.8576 mm, where $R_d$ is the radius of the cylindrical conducting wall connecting the top and bottom circular metal disks. The Butler matrix 134 is a 4×4 Butler matrix including one 90° and three 180° hybrids 136, implemented in microstrip, with the bottom disk used as a ground plane. Optionally, grounded via fences may be used to separate the phase-mode feed probes 108 in a microstrip or stripline layer. The element connections are arranged so as to maintain the same polarizations relative to the planar (x-y) axes and may include subarrays having a figure-eight azimuth pattern whose lobes are tangential to the circle of their array.

Other configurations of the waveguide assembly 130 may be suitable, for example where the antenna array has a non-circular arrangement of radiating elements. For example, where the antenna array is a polygonal array, the waveguide assembly 130 may have a corresponding polygonal shape.

Figure 4:
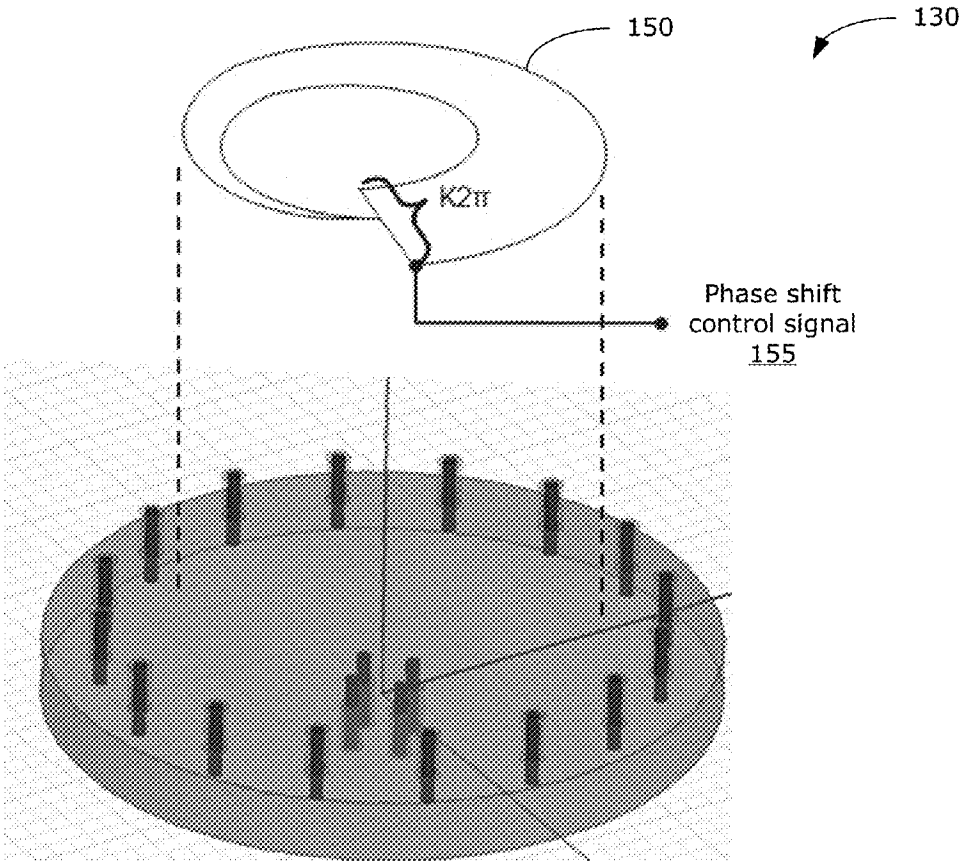
FIG. 4 schematically illustrates the incorporation of a variable phase shifter into a waveguide assembly suitable for use in the feed network of FIG. 2.

FIG. 4 schematically represents a variable phase shifter 150 incorporated into the waveguide assembly 130. The variable phase shifter 150 is positioned in the waveguide assembly 130 such that the TEM wave propagating radially between the radiating element probes 104 and the phase-mode feed probes 108 experiences an electrical phase shift ranging linearly from 0 to 2πK radians with the azimuthal angular direction of propagation inside the TEM radial waveguide assembly 130. The variable phase shifter 150 thus causes additional phase shift at the radiating elements, from a phase shift of 0 to a phase shift of 2πK radians, where K is a selectable integer value controlled by the phase shift control signal 155, where the phase shift progresses for one complete physical angular cycle around the plane of the waveguide assembly 130. The phase shifter 150 causes a phase shift in the radiating elements that progresses linearly from 0 to 2πK radians, which effects a K-th order phase mode that adds directly to the order of each phase-mode generated by the Butler matrix 134 and phase-mode feed probes 108. Generally, for N radiating elements, the variable phase shifter 150 causes an additional phase shift at the m-th radiating element that is equal to (m2πK)/N. Where the radiating elements are arranged in a circular arrangement in a planar circular antenna array, the radiating element at a first position has an additional phase shift of (2πK)/N, and the phase shift linearly increases in a circular direction (as represented as a spiral shown in FIG. 4) such that the radiating element at the Nth position (which is adjacent to the first position) has an additional phase shift of 2πK. In some examples, the phase shift control signal 155 may be provided as an adjustable voltage signal proportional to K. The phase shift control signal 155 may be provided by the beam steering circuitry 120 or by a separate circuitry.

To help in understanding the present disclosure, the antenna-side probe signals $C_1$, $C_2$, $C_3$, $C_4$ at the Butler matrix 134 may be mathematically related to the radiating element probe signals $A_1$ to $A_N$ (one signal for each of the N radiating element probes 104), to within a complex constant z, as shown below. It should be noted that this is a strictly mathematical representation, and is not intended to be representative of the actual implementation in the antenna array system 100.

$$\begin{bmatrix} C_1 \\ C_2 \\ C_3 \\ C_4 \end{bmatrix} = z \begin{bmatrix} D_{11} & \dots & D_{1n} \\ D_{21} & \dots & D_{2N} \\ D_{31} & \dots & D_{3N} \\ D_{41} & \dots & D_{4N} \end{bmatrix} [K] \begin{bmatrix} A_1 \\ \vdots \\ A_N \end{bmatrix}$$

where $[D]_{CN}$ represents the propagation factor between the C-th phase-mode feed probe 108 (C=1, . . . , 4 in this example) in the disc-shaped TEM waveguide region 106 and the N-th radiating element probe 104, N being any suitable number. The matrix [K] represents the effect of the variable phase shifter 150, and is represented by the N×N diagonal matrix having a linear progression of phases in the propagation factors, which are responsible for augmenting the order of the phase modes accessible at the phase-mode feed ports 110 (in accordance with the integer K provided by the phase shift control signal 155). The matrix [K] can be represented as:

$$[K] = \begin{bmatrix} e^{\frac{-j2\pi K}{N}} & 0 & & \dots & & 0 \\ 0 & e^{\frac{-j2\pi 2K}{N}} & 0 & \dots & & 0 \\ & 0 & \ddots & & & \\ & & & e^{\frac{-j2\pi nK}{N}} & & \\ \vdots & \vdots & & & \ddots & \vdots \\ & & & & \ddots & 0 \\ 0 & 0 & & \dots & 0 & e^{\frac{-j2\pi NK}{N}} \end{bmatrix}$$

Figure 5:
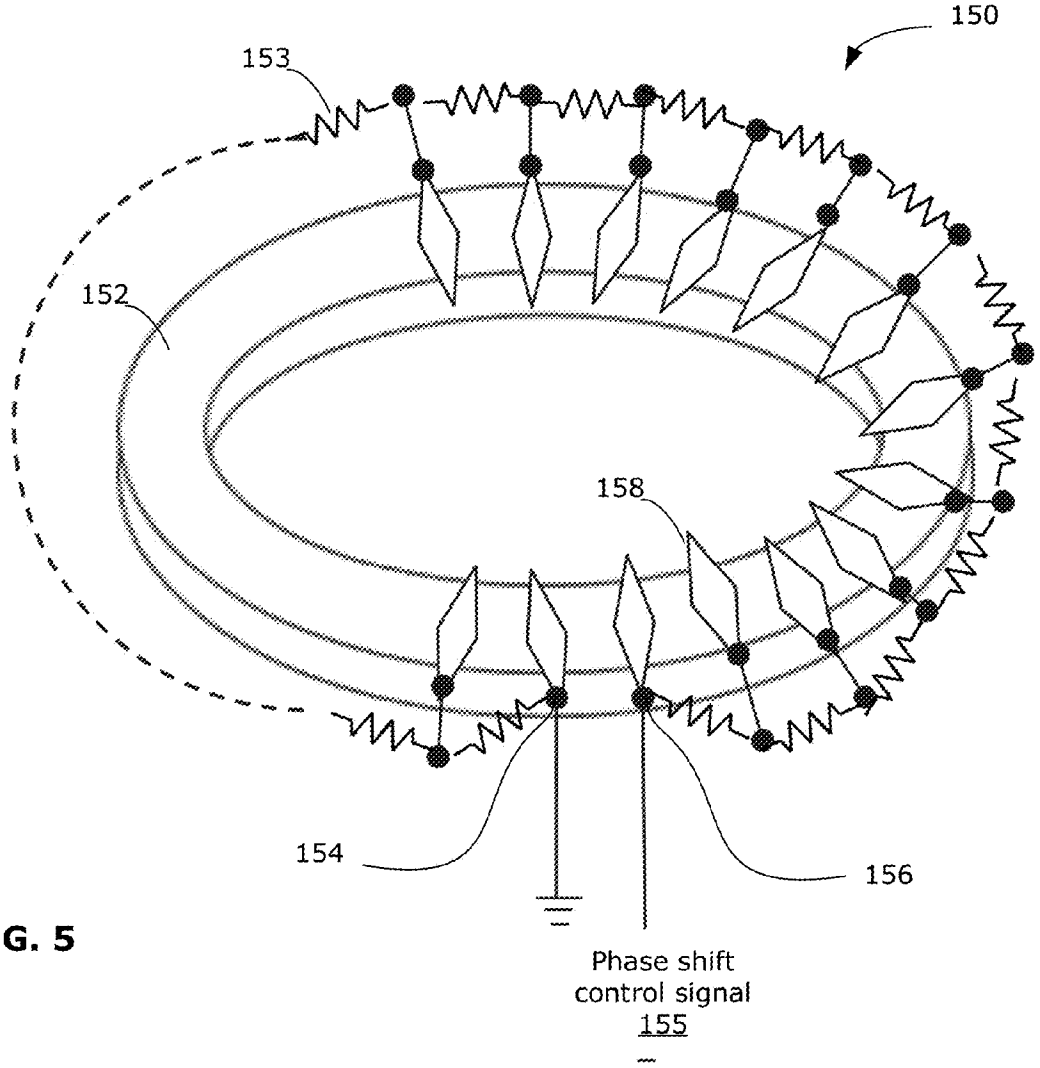
FIG. 5 is a schematic diagram illustrating an example liquid-crystal analog implementation of a variable phase shifter.

FIG. 5 is a schematic diagram illustrating an example liquid-crystal analog implementation of the variable phase shifter 150. The example variable phase shifter 150 shown in FIG. 5 may be incorporated into the dielectric between the two disks of the waveguide assembly 130, for example. In this example, the variable phase shifter 150 has a circular configuration, to cause phase shift in a planar circular antenna array. The variable phase shifter 150 may be configured similarly to the liquid-crystal analog phase shifter described in U.S. patent application Ser. No. 14/603,908 filed Jan. 23, 2015 and entitled "Phase Control for Antenna Array", incorporated herein by reference in its entirety. In the example of FIG. 5, the spiral phase shifter 150 has a torus-shaped liquid crystal compartment 152. The liquid crystal compartment 152 may be similar to that described by Kuangda Wang and Ke Wu in "Liquid Crystal Enabled Substrate Integrated Waveguide Variable Phase Shifter for Millimeter-Wave Applications at 60 GHz and Beyond", *Proceedings of IEEE International Microwave Symposium IMS,* 2015, incorporated herein by reference in its entirety. A plurality of electrodes 158 are positioned radially around the liquid crystal compartment 152 and are connected by identical resistors 153. The variable phase shifter 150 has a first end 154 connected to ground, and a second end 156 that receives the phase shift control signal 155 (which may be in the form of a control voltage). The variable phase shifter 150 generates an electric field that causes the progressive phase shift in the radiating elements. It should be noted that the number of electrodes 158 does not necessarily correspond to the number of radiating elements in the antenna array. However, it may be useful for the number of electrodes 158 to be equal to the number of radiating elements, to ensure that the phase shift caused in the radiating elements progresses linearly from 0 to 2πK radians. Other configurations for the variable phase shifter 150 may be used. For example, where the antenna array has a non-circular arrangement of radiating elements, the variable phase shifter 150 may correspondingly be non-circular in shape. It should be noted that the variable phase shifter 150 is positioned in the waveguide assembly 130 to occupy the annular region between the phase-mode feed probes 108 and the radiating element probes 104. In examples where the waveguide assembly 130 has several rings of radiating element probes 104 to couple to a fully or partially-filled antenna array, or where the waveguide assembly 130 is for coupling to slot-coupled radiating elements, the variable phase shifter 150 may be positioned in the annular region between the phase-mode feed probes 108 and the smallest ring of radiating element probes 104 or slots.

Figure 6:
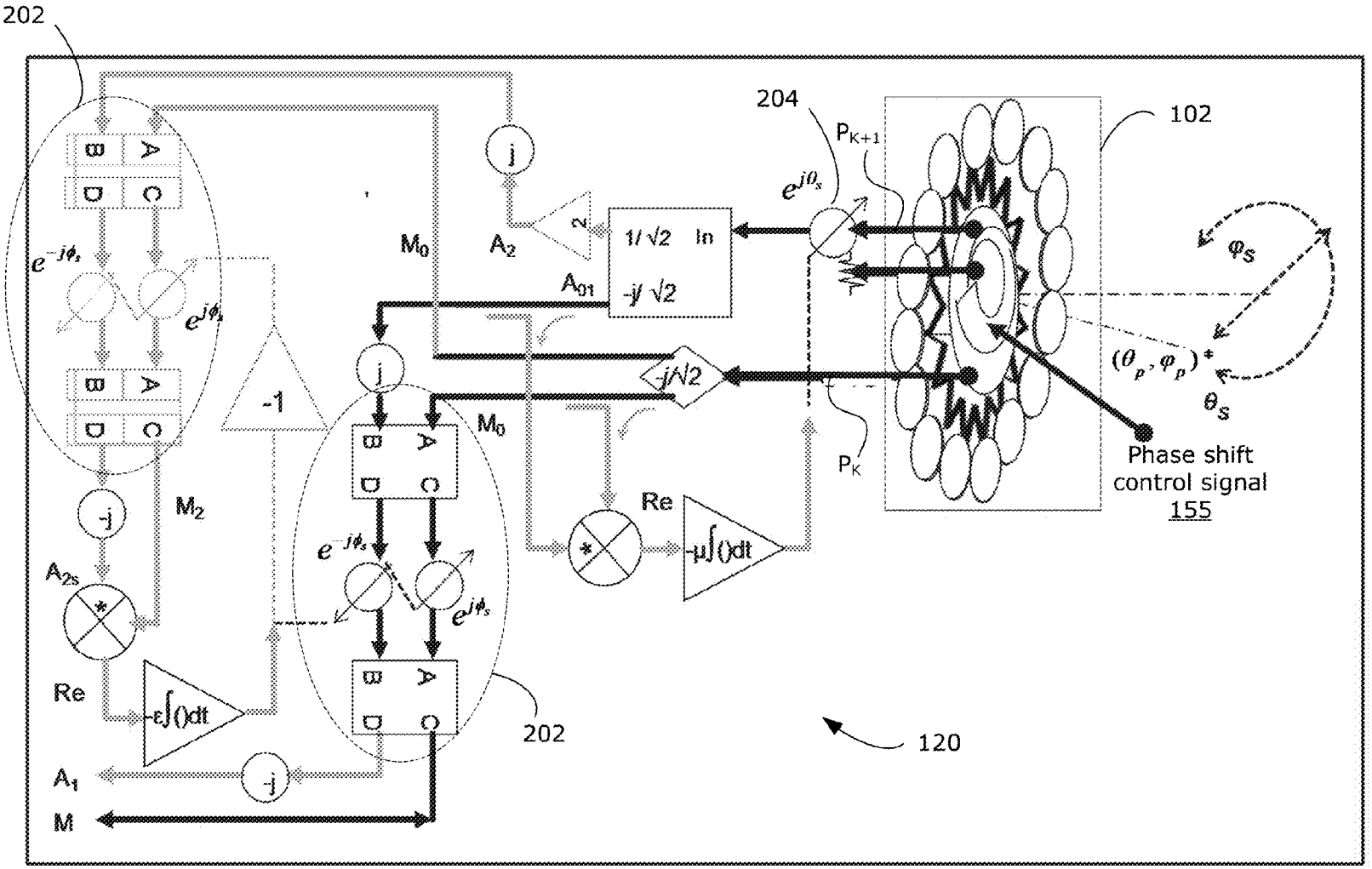
FIG. 6 is a schematic diagram of an example beam steering circuitry suitable for use in the system of FIG. 1.

FIG. 6 shows an example of the beam steering circuitry 120, suitable for use with an example feed network 102 as described herein. The beam steering circuitry 120 controls the polar angle $\varphi_s$ and azimuth angle $\theta_s$ of the main beam M. In FIG. 6, the feed network 102 for a circular antenna array is represented as a star shape inside a ring of ellipses representing the radiating elements of the antenna array. The spiral shape inside the star shape represents the variable phase shifter. In this example, the signal $P_{K-1}$, corresponding to the (K−1)th phase mode, is terminated, although in other examples the $P_{K-1}$ signal may be used and the $P_{K+1}$ signal may be terminated instead. The $P_{K+1}$ and $P_K$ signals are coupled to the beam steering circuitry 120, and are combined, according to the circuitry shown. The example circuitry includes two variable-ratio combiners 202 that set the polar angle $\varphi_s$ by varying the electrical phase of its internal opposed phase shifters by $\pm\varphi_s$. The variable-ratio combiners 202 each includes two hybrid splitters/combiners that are coupled to each other via two phase shifters that provide equal but opposite amounts of phase shifts.

The $P_{K+1}$ signal is coupled to a phase shifter 204 that sets the azimuth angle $\theta_s$. The output of the beam steering circuitry 120 is the main beam M, as well as an auxiliary signal $A_1$, which may be used for other purposes, including interference mitigation, direction finding and/or feedback control, for example. In the example shown, M and $A_1$ are as follows:

$$M=(-j/\sqrt{2})[P_K \cos \phi_s - P_{K+1}e^{j\theta_s} \sin \phi_s]$$

$$A_1=(-j/\sqrt{2})[P_K \sin \phi_s - P_{K+1}e^{j\theta_s} \cos \phi_s]$$

Figure 8:
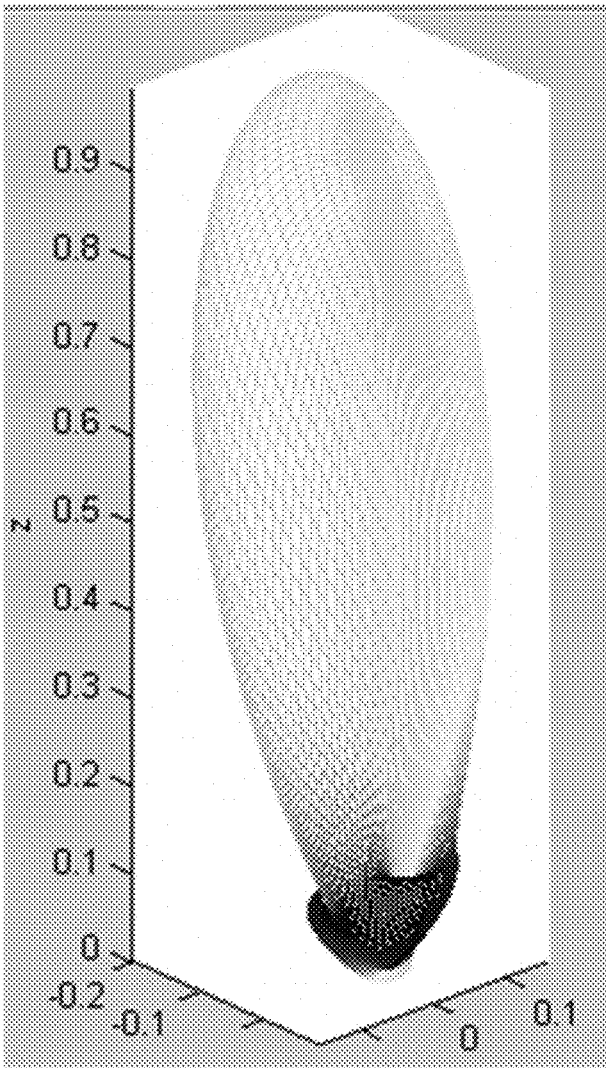
FIG. 8 shows a simulation of the radiation pattern of an example main beam without using higher order phase modes (where K=0)
Figure 9:
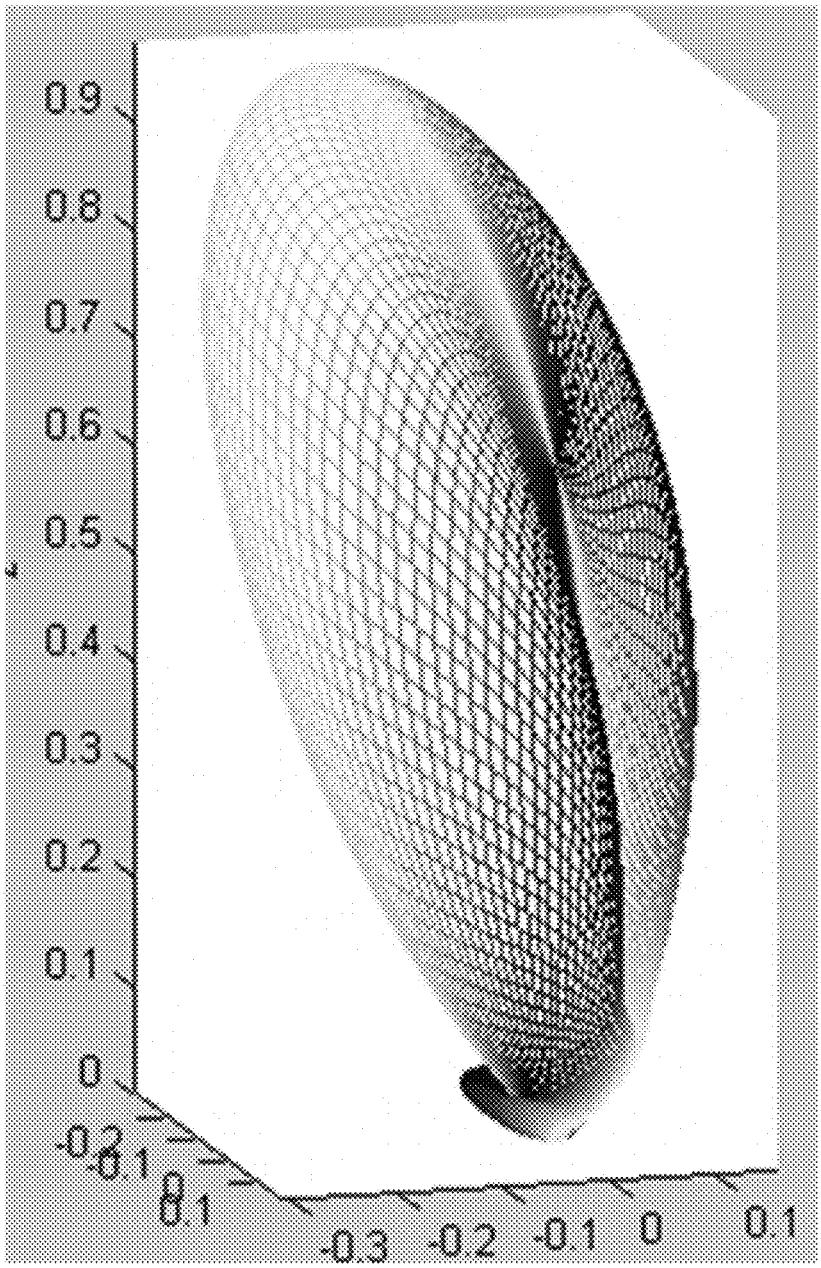
FIG. 9 shows a simulation of the radiation pattern of an example main beam where higher order phase modes are combined (where K=2).

The example circuitry in FIG. 6 provides for both azimuthal and radial steering of the main beam. The phase shift control signal 155 controls the amount of phase shift caused by the variable phase shifter, which in turn determines the order of the phase modes coupled to the beam steering circuitry 120. Using the phase shift control signal 155, different values of K can be selected to access higher orders of phase modes. By combining higher orders of phase modes, hence greater axial tilt in the radial direction (i.e., greater values of polar angle $\varphi_s$) can be achieved in the main beam M. The azimuthal steering direction $\theta_s$ can be varied independently by the phase shifter 204 for any radial tilt direction, including different values of K. FIG. 8 shows a simulation of the radiation pattern of an example main beam M generated by the circuitry of FIG. 6, where K=0 (i.e., combining the 0th and first phase modes). FIG. 9 shows a simulation of the radiation pattern of an example main beam M generated by the circuitry of FIG. 6, where K=2 (i.e., combining the second and third phase modes). It can be seen that the radiation pattern in FIG. 9 has a greater axial tilt and is also more spread out than the radiation pattern in FIG. 8.

Figure 7:
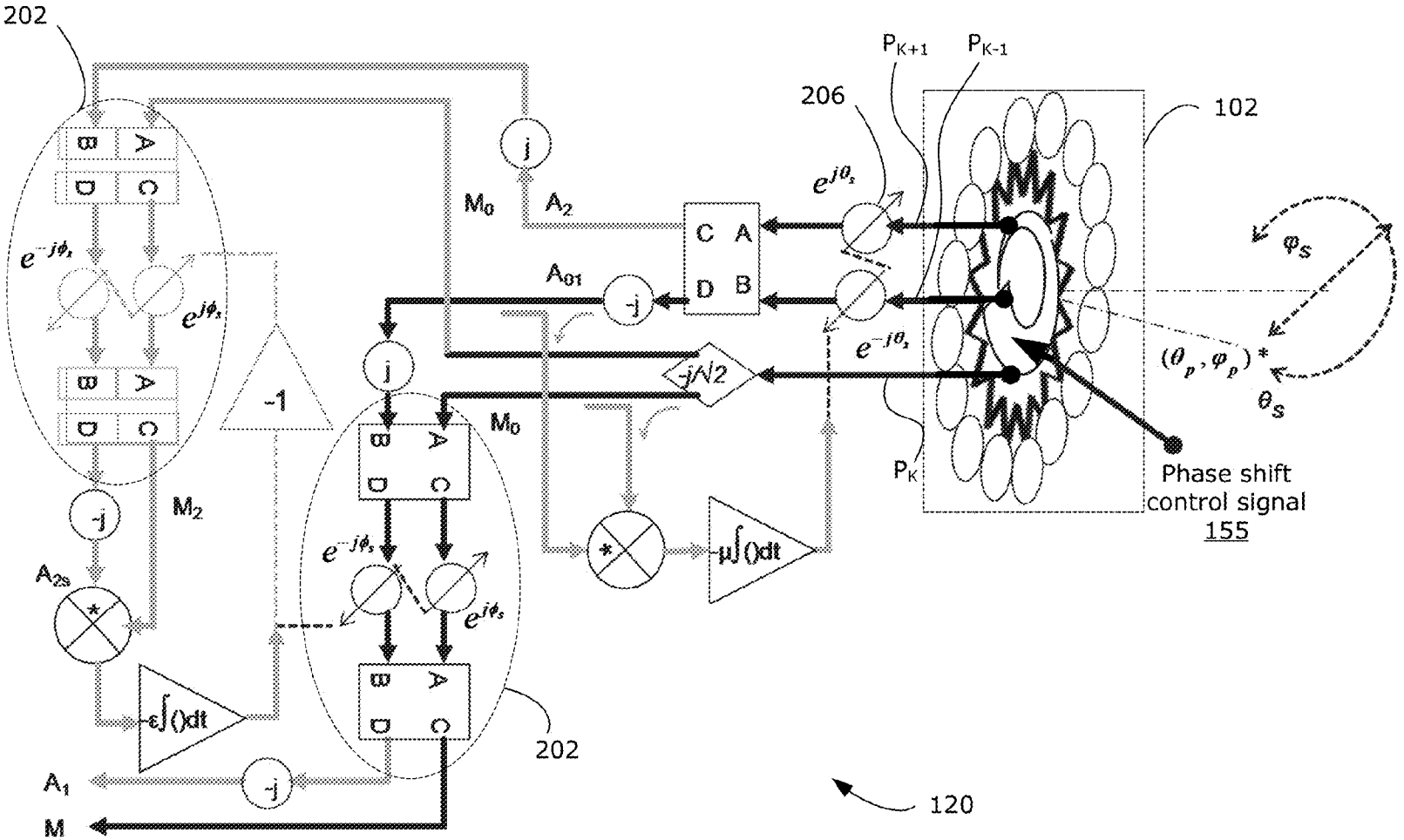
FIG. 7 is a schematic diagram of another example beam steering circuitry suitable for use in the system of FIG. 1.

FIG. 7 shows another example of the beam steering circuitry 120. The circuitry in FIG. 7 is similar to the circuitry of FIG. 6, however the signals $P_{K+1}$ and $P_{K-1}$ are coupled to phase shifters 206 that provide equal but opposite amounts of phase shifts. The radiating elements in a planar circular antenna array may be radially-symmetric. Sub-arrays with radial or uniform polarization axes in a circular arrangement causes phase mode offset. For example, when the radiating elements have polarizations with radial symmetry, there is a shift of one in the order of the phase modes. This shift can be compensated, using the example circuitry of FIG. 7, by setting K=+/−1, so as to obtain the intended phase modes $P_0$, $P_1$ and which are used for beam steering in this example configuration. In the example of FIG. 7, M and $A_1$ are as follows, (with K=0 in the case when all polarization directions are identical with respect to Cartesian coordinates and no compensation would be required):

$$M=(-j/\sqrt{2})[P_K \cos \phi_s - (P_{K+1}e^{j\theta_s} - P_{K-1}e^{-j\theta_s})\sin \phi_s]$$

$$A_1=(-j/\sqrt{2})[P_K \sin \phi_s + (P_{K+1}e^{j\theta_s} - P_{K-1}e^{-j\theta_s})\cos \phi_s]$$

Although FIGS. 6 and 7 show example beam steering circuitry that may be used, other beam steering circuitry may be suitable. Two or more beam steering circuits may be co-integrated.

In various examples described herein, the present disclosure enables two-axis phase mode-enabled beam steering with greater tilt from the z-axis (i.e., greater polar angle). Feed losses and the number of phase shifters used may also be reduced. The feed network and the antenna array may be integrated into a single planar structure. In examples where the feed network is used for a circular planar antenna array, examples described herein may facilitate integration with axially-radiating circular antenna arrays. In a multiple-band design, concentric stacking of the feed network may be possible.

Although examples provided herein show implementation for a planar circular antenna array, the teachings of this disclosure may be adapted to non-circular antenna arrays, including polygonal (e.g., square) antenna arrays, as well as partially-filled antenna arrays. For polygonal antenna arrays, the variable phase shifter is again positioned in the annular region between the central phase-mode feed probes and the radiating element probes, and the phase shift progresses in a linear progression in a circumferential direction around the polygon.

Adaptation for use with a filled circular antenna array (e.g., a radial slot antenna array) with concentric rings of radiating elements may also be possible. In such an implementation, the radiating element probes are correspondingly arranged in concentric rings. It may be useful to interpose one or more additional variable phase shifters in, and concentric with, the one or more annular regions between adjacent rings of radiating element probes so as to obtain a superposition of several phase modes in the same polar-angle tilt region. An example of an antenna array with concentric rings of radiating elements is described by Tiezhu Yuan, Hongqiang Wang, Yuliang Qin, and Yongqiang Cheng in "Electromagnetic Vortex Imaging Using Uniform Concentric Circular Arrays" *IEEE Antennas and Wireless Propagation Letters*, Vol. 15, pp. 1024-1027, 2016, incorporated herein by reference in its entirety.

The present disclosure may be embodied in other specific forms without departing from the subject matter of the claims. The described example embodiments are to be considered in all respects as being only illustrative and not restrictive. Selected features from one or more of the above-described embodiments may be combined to create alternative embodiments not explicitly described, features suitable for such combinations being understood within the scope of this disclosure.

All values and sub-ranges within disclosed ranges are also disclosed. Also, although the systems, devices and processes disclosed and shown herein may comprise a specific number of elements/components, the systems, devices and assemblies could be modified to include additional or fewer of such elements/components. For example, although any of the elements/components disclosed may be referenced as being singular, the embodiments disclosed herein could be modified to include a plurality of such elements/components. The subject matter described herein intends to cover and embrace all suitable changes in technology.

The invention claimed is:

1. A feed network for a steerable antenna array, the feed network comprising:

a waveguide assembly including a plurality of radiating element probes for coupling to respective radiating elements of the antenna array, and a plurality of phase-mode feed probes;

a variable phase shifter positioned in the waveguide assembly in an annular region between the radiating element probes and the phase-mode feed probes to cause additional phase shifts of the radiating elements of the antenna array, the phase shifter configured to cause additional progressive electrical phase shifts in the antenna array from 0 to $2\pi K$ radians, the phase shift progressing for one complete physical angular cycle in a plane of the waveguide assembly, where K is an integer value represented by a phase shift control signal; and a beam forming network coupling the phase-mode feed probes to a plurality of phase-mode feed ports corresponding to respective consecutive-order phase modes of the antenna array;

wherein, when coupled to the antenna array, respective orders of the phase modes provided at the phase-mode feed ports are selectable in accordance with K.

2. The feed network of claim 1, wherein the waveguide assembly is configured for a circular antenna array, and the progressive phase shifts caused by the variable phase shifter progresses linearly in a circular direction.

3. The feed network of claim 1, wherein the waveguide assembly is configured for a polygonal antenna array.

4. The feed network of claim 1, wherein the variable phase shifter is a liquid crystal analog phase shifter.

5. The feed network of claim 1, wherein there are three phase-mode feed ports, and the orders of the phase modes provided at the phase-mode feed ports are K, K+1 and K−1.

6. The feed network of claim 1, wherein the beam forming network is a Butler matrix.

7. The feed network of claim 6, wherein the Butler matrix is a 4×4 Butler matrix comprising four hybrid splitter/combiners.

8. The feed network of claim 1, wherein the waveguide assembly is configured for an antenna array having two or more concentric rings of radiating elements, the radiating element probes being correspondingly arranged in concentric rings, the feed network further comprising one or more additional variable phase shifters respectively positioned in, and concentric with, one or more annular regions between adjacent rings of the radiating element probes.

9. An apparatus for beam steering a steerable antenna array, the apparatus comprising:

a feed network including:

a waveguide assembly including a plurality of radiating element probes for coupling to respective radiating elements of the antenna array, and a plurality of phase-mode feed probes;

a variable phase shifter positioned in the waveguide assembly in an annular region between the radiating element probes and the phase-mode feed probes to cause additional phase shifts of the radiating elements of the antenna array, the phase shifter configured to cause additional progressive electrical phase shifts in the antenna array from 0 to $2\pi K$ radians, the phase shift progressing for one complete physical angular cycle in a plane of the waveguide assembly, where K is an integer value represented by a phase shift control signal; and a beam forming network coupling the phase-mode feed probes to a plurality of phase-mode feed ports corresponding to respective consecutive-order phase modes of the antenna array;

wherein, when coupled to the antenna array, respective orders of the phase modes provided at the phase-mode feed ports are selectable in accordance with K; and a beam steering circuitry coupled to two or more phase-mode feed ports of the feed network, the beam steering circuitry combining phase modes from two or more of the phase-mode feed ports to generate a main beam of the steerable antenna array, the beam steering circuitry controlling the polar angle and azimuth angle of the main beam to direct the main beam in a desired direction.

10. The apparatus of claim 9, wherein the waveguide assembly is configured for a circular antenna array, and progressive phase shift caused by the variable phase shifter progresses in a circular direction.

11. The apparatus of claim 9, wherein the variable phase shifter is a liquid crystal analog phase shifter.

12. The apparatus of claim 9, wherein there are three phase-mode feed ports, and the orders of the phase modes provided at the phase-mode feed ports are K, K+1 and K−1.

13. The apparatus of claim 12, wherein the beam steering circuitry is coupled to the phase-mode feed ports providing K and one of K+1 or K−1 order phase modes, and the main beam is generated by a combination of the K and K+1 or K−1 order phase modes.

14. The apparatus of claim 9, wherein the beam steering circuitry is coupled to the phase-mode feed ports providing K, K+1 and K−1 order phase modes, and wherein K is selected to be +/−1 in order to compensate for phase mode offset due to radial symmetry of polarization of the radiating elements in a planar circular antenna array.

15. The apparatus of claim 9, wherein the waveguide assembly is configured for an antenna array having two or more concentric rings of radiating elements, the radiating element probes being correspondingly arranged in concentric rings, the feed network further comprising one or more additional variable phase shifters respectively positioned in, and concentric with, one or more annular regions between adjacent rings of the radiating element probes.

16. A steerable antenna array system comprising:

a plurality of radiating elements arranged in a planar antenna array;

a feed network including:

a waveguide assembly including a plurality of radiating element probes for coupling to respective radiating elements of the antenna array, and a plurality of phase-mode feed probes;

a variable phase shifter positioned in the waveguide assembly in an annular region between the radiating element probes and the phase-mode feed probes to cause additional phase shifts of the radiating elements of the antenna array, the phase shifter configured to cause additional progressive electrical phase shifts in the antenna array from 0 to $2\pi K$ radians, the phase shift progressing for one complete physical angular cycle in a plane of the waveguide assembly, where K is an integer value represented by a phase shift control signal; and a beam forming network coupling the phase-mode feed probes to a plurality of phase-mode feed ports corresponding to respective consecutive-order phase modes of the antenna array;

wherein, when coupled to the antenna array, respective orders of the phase modes provided at the phase-mode feed ports are selectable in accordance with K; and a beam steering circuitry coupled to two or more phase-mode feed ports of the feed network, the beam steering circuitry combining phase modes from two or more of the phase-mode feed ports to generate a main beam of the steerable antenna array, the beam steering circuitry controlling the polar angle and azimuth angle of the main beam to direct the main beam in a desired direction.

17. The system of claim 16, wherein the radiating elements are arranged in a planar circular antenna array, and wherein progressive phase shift caused by the variable phase shifter progresses linearly in a circular direction.

18. The system of claim 17, wherein the radiating elements having radially-symmetric polarization, wherein K is selected to be +/−1 in order to compensate for phase mode offset of the antenna array.

19. The system of claim 16, wherein the antenna array comprises two or more concentric rings of radiating elements, and wherein the radiating element probes are correspondingly arranged in concentric rings, the feed network further comprising one or more additional variable phase shifters respectively positioned in, and concentric with, one or more annular regions between adjacent rings of the radiating element probes.

20. The system of claim 16, wherein the variable phase shifter is a liquid crystal analog phase shifter.

21. The system of claim 16, wherein there are three phase-mode feed ports, and the orders of the phase modes provided at the phase-mode feed ports are K, K+1 and K−1.

22. The system of claim 21, wherein the beam steering circuitry is coupled to the phase-mode feed ports providing K and one of K+1 or K−1 order phase modes, and the main beam is generated by a combination of the K and K+1 or K−1 order phase modes.

* * * * *